United States Patent [19]

Deming et al.

[11] Patent Number: 4,595,057

[45] Date of Patent: Jun. 17, 1986

[54] PARALLEL STRING METHOD FOR MULTIPLE STRING, THERMAL FLUID INJECTION

[75] Inventors: John R. Deming, Moraga; Suzanne Griston, San Dimas; Ki C. Hong, Orange, all of Calif.

[73] Assignee: Chevron Research Company, San Francisco, Calif.

[21] Appl. No.: 611,794

[22] Filed: May 18, 1984

[51] Int. Cl.[4] ..... E21B 36/00; E21B 43/24

[52] U.S. Cl. ..... 166/269; 166/57; 166/191; 166/272; 166/303; 166/313

[58] Field of Search ..... 166/303, 258, 269, 272, 166/302, 313, 57, 191

[56] References Cited

U.S. PATENT DOCUMENTS

| | | | |
|---|---|---|---|
| 1,876,627 | 9/1932 | Davis et al. . | |
| 2,133,730 | 10/1938 | Bundred . | |
| 2,148,717 | 2/1939 | Whitney | 166/272 |
| 3,116,792 | 1/1964 | Purre | 166/258 X |
| 3,159,215 | 12/1964 | Meldau et al. | 166/258 |
| 3,372,750 | 3/1968 | Satter et al. | 166/272 |
| 3,451,479 | 6/1969 | Parker | 166/57 X |
| 3,467,191 | 9/1969 | Van Daalen et al. | 166/269 |
| 3,692,111 | 9/1972 | Breithaupt et al. | 166/272 X |
| 3,842,912 | 10/1974 | Lindsey, Jr. | 166/313 X |
| 4,037,658 | 7/1977 | Anderson | 166/272 |
| 4,248,302 | 2/1981 | Churchman | 166/272 |
| 4,392,530 | 7/1983 | Odeh et al. | 166/272 X |
| 4,424,859 | 1/1984 | Sims | 166/313 X |

*Primary Examiner*—George A. Suchfield

*Attorney, Agent, or Firm*—John A. Rafter, Jr.; Edward J. Keeling

[57] ABSTRACT

A method for thermal fluid injection into a plurality of strata wherein a well is packed off to establish a first and a second zone. A first tubing string is introduced and is terminated in the first zone. The first tubing string is paralleled by a second tubing string. The first and second tubing strings are physically separated. A first fluid at a first temperature is injected into the first tubing string while a second fluid at a second temperature is simultaneously injected into the second tubing string. The first fluid at the first temperature is applied to the first zone while the second fluid at the second temperature is applied to the second zone.

6 Claims, 3 Drawing Figures

PARALLEL STRING METHOD FOR MULTIPLE STRING, THERMAL FLUID INJECTION

BACKGROUND OF THE INVENTION

The present invention pertains in general to methods for multiple string, thermal fluid injection and in particular to parallel string, thermal fluid injection methods.

An oil-producing well may pass through several petroleum containing strata. These strata may differ in permeability, homogeneity and thickness. Furthermore, the petroleum in these strata may differ in amount, viscosity, specific gravity and average molecular weight.

Where petroleum within a stratum is so viscous that the temperature and pressure within the stratum are insufficient to cause it to flow to a producing well, hot fluids, particularly steam, are injected into such strata in order to raise the temperature of the stratum and thereby reduce the viscosity of the petroleum contained therein to a point at which the petroleum flows to a producing well bore.

In some wells, it is desirable to treat more than one stratum with hot fluids. Where these strata require different injection techniques, which may include the use of fluids at different temperatures (hereinafter "thermal fluid injection") and different pressures, separate conduction pathways are used for each different type of fluid.

Commonly, for thermal fluid injection, metallic steam injection tubing is run into wells which have been drilled and cased. Packers are placed between the tubing and the casing above and sometimes below the stratum to be injected. Next, the wellhead is connected to a source of hot fluid, such as a steam generator. The hot fluid is pumped into the stratum formation through the tubing.

Two types of tubing strings have been used or suggested for simultaneous thermal fluid injection into more than one stratum.

In the first type, concentric tubing strings of the sort shown in U.S. Pat. No. 4,399,865, are formed by running a first steam-bearing pipe within a second to form two flow channels. In the second type, a multichannel conduit, of the sort shown in U.S. Pat. No. 4,424,859, is composed of a plurality of contiguous flow channels within a cylindrical shell.

Both of these types of tubing string suffer from a severe problem of heat transfer between flow channels. Uninsulated channels in either of these two types of strings act as heat exchangers and thereby reduce the efficiency of any attempt to inject fluids at *different* temperatures into separate strata. Insulated flow channels, although more thermally effective, have size and cost disadvantages.

SUMMARY OF THE INVENTION

Accordingly, the present invention involves a method for multiple string thermal fluid injection into a well. The well is packed off to establish a first and a second zone. A first tubing string is introduced and is terminated in the first zone. The first tubing string is paralleled by a second tubing string. The first and second tubing strings are physically separated. A first fluid at a first temperature is injected into the first tubing string while a second fluid at a second temperature is simultaneously injected into the second tubing string. The first fluid at the first temperature is applied to the first zone while the second fluid at the second temperature is applied to the second zone.

DESCRIPTION OF THE PREFERRED EMBODIMENTS

A parallel multiple string apparatus, in U.S. Pat. No. 2,133,730, for example, has been used for water flooding in order to better control the fluid pressure applied to different strata. Also, parallel dual string apparatus (i.e., two parallel strings) has been applied to a single stratum of tar sand in U.S. Pat. No. 4,248,302 where side pocket mandrels from one of two steam lines provides a steam drive for several production wells.

However, prior to the present invention no use has been made of the thermal isolation provided by parallel string apparatus in order to control the injection of fluids at different temperatures into separate strata.

Figure 1:
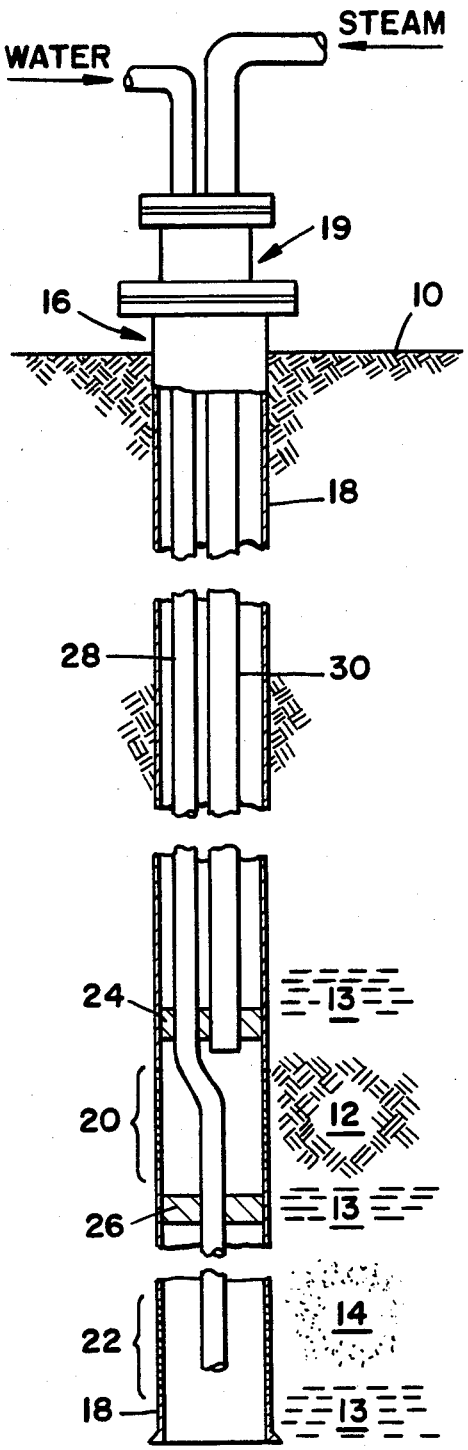
FIG. 1 is a perspective view in partial cross-section of a well for practicing the method according to the present invention.

In exemplary apparatus for practicing the present invention, as illustrated in FIG. 1, an earth formation 10 has strata 12 and 14 penetrated by a well 16. Impermeable strata 13 separate strata 12 and 14 from other strata and from each other. Well 16 has a casing 18 penetrated by perforations 20 at stratum 12 and by perforations 22 at stratum 14.

A top packer 24 and a bottom packer 26 are placed between the surface and a first zone at stratum 14 and the first zone and a second zone at stratum 12 respectively. Perforations 22 are within the first zone and perforations 20 are within the second zone.

A first tubing string 28 and a second tubing string 30 are hung within well 16 through a wellhead 19. Tubing string 28 terminates in the first zone while tubing string 30 ends in the second zone. A portion 28*a* of tubing string 28 lies between packers 24 and 26. Section 28*a* is bent to centralize string 28 at packer 26 and is insulated to minimize heat transfer.

Figure 2:
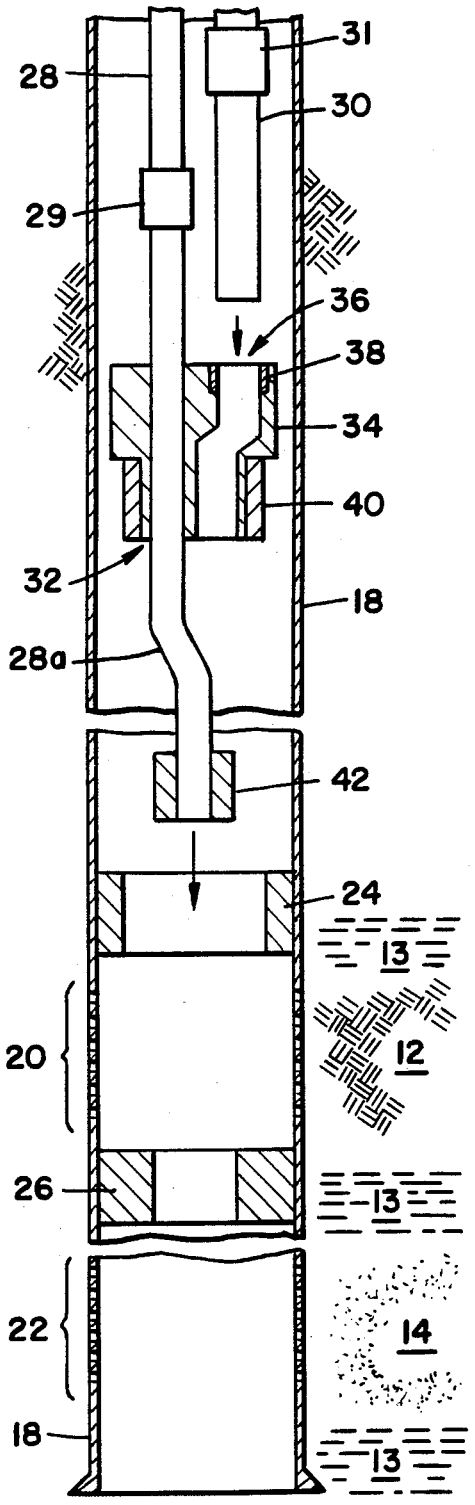
FIG. 2 is a perspective view in partial cross-section showing the assembly of a tubing string according to the method of the present invention.

A more detailed depiction of the lower portion of the apparatus of FIG. 1 is shown in FIG. 2, wherein the structures also shown in FIG. 1 are referenced by the same numerals used to identify them in FIG. 1. In FIG. 2, it is shown that strings 28 and 30 may be respectively provided with downhole expansion joints 29 and 31. Above bent portion 28*a*, string 28 is connected through a first channel 32 of a parallel flow tube 34. A second channel 36 of flow tube 34 is bent to centralize fluid passage through packer 24.

A first seal 38 is provided within the upper portion of channel 36. A second seal 40 surrounds the lower portion of flow tube 34. A third seal 42 surrounds the lower end of string 28 and is spaced from flow tube 34 so that the distance between them is the same as the distance between packers 24 and 26.

Tubing string 28 is connected to a source (not shown) of a first fluid, which may be water, for example, at a first temperature. Similarly, tubing string 30 is connected to a source (not shown) of a second fluid, which may be steam, for example, at a second temperature.

Section 28*a* may be any suitable insulated tubing, such as that sold under the THERMOCASE 550 trademark by General Electric Company, Thermal Systems Marketing Division, Tacoma, Wash. All other components of apparatus for practicing the present invention are readily obtainable or readily modifiable from readily obtained equipment by those skilled in the art.

According to the method of the present invention, packers 24 and 26 are set by wireline respectively above and below perforations 20 at stratum 12 to establish a first zone around perforations 22 and a second zone around perforations 20. String 28, with attached flow tube 34 and attached seal 38, 40 and 42, is stabbed into packers 24 and 26, thereby terminating string 28 in the first zone below packer 26. String 30 is paralleled with string 28 by stabbing string 30 into seal 38, thereby ending string 30 in the second zone through flow tube 34. Strings 28 and 30 are also physically separated by flow tube 34 and by passing separately through wellhead 18.

The first fluid is injected at a first temperature through string 28 and applied in the first zone to stratum 14 at perforations 22. The second fluid is injected at a second temperature through string 30 and applied in the second zone to stratum 12 at perforations 20.

Figure 3:
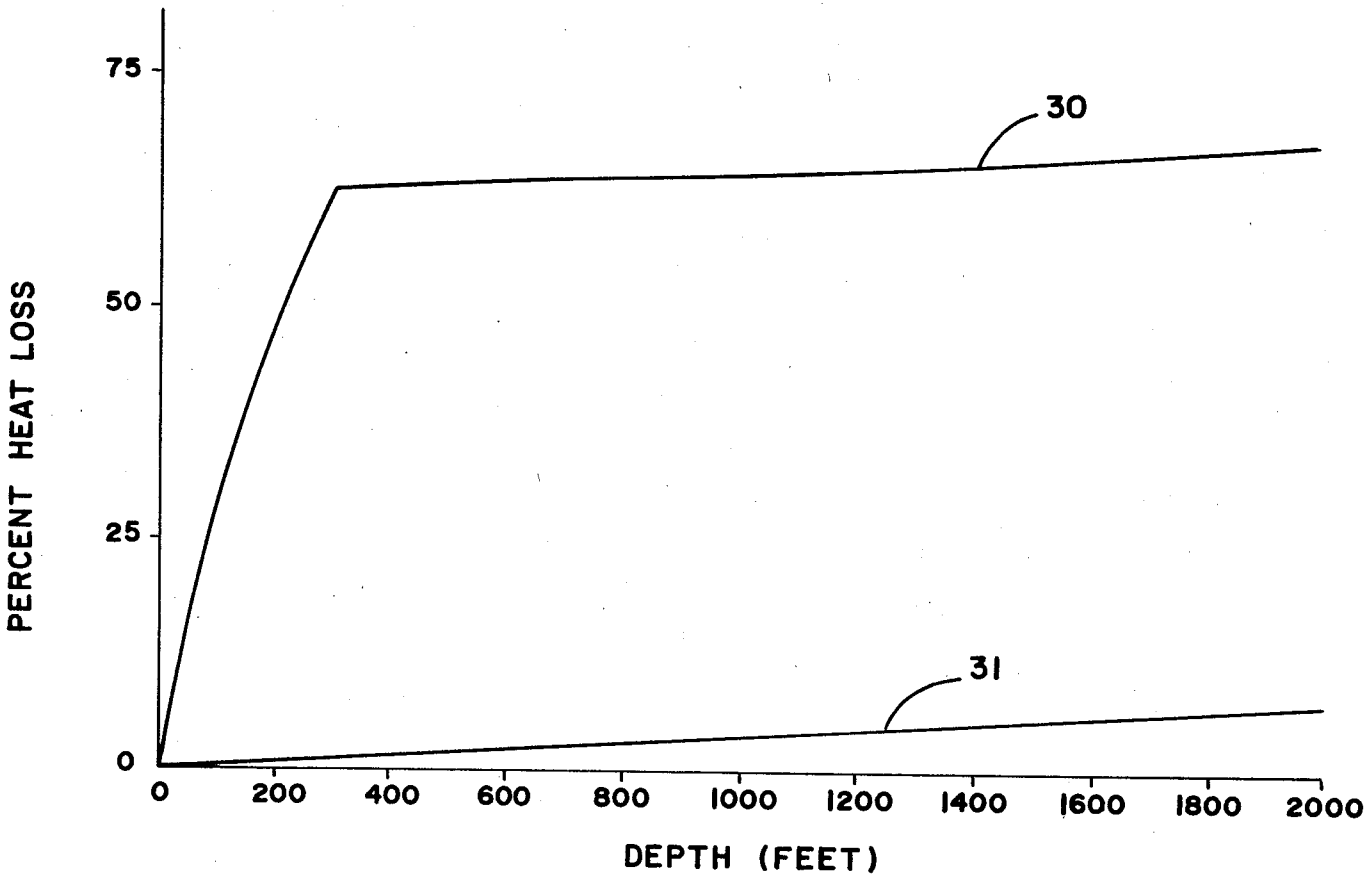
FIG. 3 is a graph of calculated theoretical heat losses for parallel dual string and concentric dual string thermal fluid injection.

FIG. 3 shows a heat transfer comparison between a steam injection string in a concentric string injection well and a dual string injection well. For this comparison, simulation studies were conducted for water injected in the inner string and for steam injected in the outer string of the concentric well, and equivalent mass flow rates per unit flow area of water and of steam injected in the individual dual strings, respectively, in the dual string well. This particular case was chosen to emphasize the major advantage of the dual string injection method over the concentric string injection method (e.g. greatly reduced heat loss from steam string to water string). As can be seen from FIG. 3, much more heat is lost from steam injected in the concentric string well, as illustrated by curve 30, than from the dual string well, as illustrated by curve 31. This is primarily due to the fact that concentric tubing acts as a long heat exchanger, causing large amounts of heat to be transferred from the hot steam string to the cooler water string. By physically separating the two strings, as in the dual string method, the heat transfer between the strings is substantially reduced.

While the present invention has been described in terms of a preferred embodiment, further modifications and improvements will occur to those skilled in the art. For example, although steam and water have respectively been given as examples of the first and second fluids, water at two different temperatures or steam at two different temperatures may also be applied to different strata following the method according to the present invention. Additives, such as foaming agents, $CO_2$ or exhaust gases, may be included in the first or second fluid within the scope of the present invention. In addition, although only two strings have been described, any number of non-contiguous strings (multiple strings) which can be conveniently introduced into a well bore may be used, with at least one string ending in each of a plurality of zones.

We desire it to be understood, therefore, that the present invention is not limited to the particular form shown and that we intend in the appended claims to cover all such equivalent variations which come within the scope of the invention as claimed.

What is claimed is:

1. A method for multiple string, thermal fluid injection within a well which penetrates at least two strata which are separated by at least one relatively impermeable strata comprising the steps of packing off the well to establish a first zone at the first stratum and a second zone at the second stratum;

introducing a first tubing string into the well;

terminating the first tubing string at the first zone;

paralleling the first tubing with a second tubing string;

ending the second tubing string at the second zone;

physically separating the first and second tubing strings;

injecting a first fluid at a first temperature into the first tubing string while simultaneously injecting a second fluid at a second temperature into the second tubing string;

insulating the first tubing string through the second zone to minimize heat transfer between the second fluid from the second tubing string and the first fluid in the first tubing string; and applying the first fluid at a first temperature to the first zone while simultaneously applying the second fluid at a second temperature to the second zone.

2. The method as recited in claim 1 wherein said injecting step comprises the step of injecting steam into the first tubing string.

3. The method as recited in claim 2 wherein said injecting step comprises the step of injecting water into the second tubing string.

4. The method as recited in claim 1 wherein said injecting step comprises the steps of injecting steam at a first temperature into the first tubing string and injecting steam at a second temperature into the second tubing string.

5. The method as recited in claim 1 wherein said injecting step comprises the steps of injecting water at a first temperature into the first tubing string and injecting water at a second temperature into the second tubing string.

6. Apparatus for injecting at least one thermal fluid down a single injection well comprising:

an injection well penetrating at least an upper and a lower producing formation;

casing within the injection well having perforations providing communication to the upper producing formation and to the lower producing formation from within the casing;

first packer means for establishing a first zone within the injection well adjacent the perforations in the casing to provide communication with the lower producing formation;

second packer means above the first packer means and cooperating therewith to establish a second zone adjacent the perforations in the casing to provide communication with the upper producing formation;

a first tubing string extending from the earth's surface through the first packer means and the second packer means and ending in the first zone;

a second tubing string extending from the earth's surface through the second packer means and ending in the second zone; and insulation means on the first tubing string below the second packer means and continuing through at least the second zone for minimizing heat transfer between fluid in the first tubing string with fluid injected from the second tubing string in the second zone.

* * * * *